United States Patent [19]

Collins

[11] Patent Number: 4,744,271

[45] **Date of Patent: * May 17, 1988**

[54] RATCHETING BOX WRENCH

[76] Inventor: Bobby W. Collins, 800 Commerce Rd., Ste. 214, New Orleans, La. 70123

[ * ] Notice: The portion of the term of this patent subsequent to Jun. 2, 2004 has been disclaimed.

[21] Appl. No.: 52,485

[22] Filed: May 21, 1987

Related U.S. Application Data

[63] Continuation of Ser. No. 786,836, Oct. 11, 1985, Pat. No. 4,669,338.

[51] Int. Cl.[4] ..... B25B 13/46

[52] U.S. Cl. ..... 81/57.39; 81/61; 81/63.1

[58] Field of Search ..... 81/57.39, 59.1, 60–63.1

[56] References Cited

U.S. PATENT DOCUMENTS

| | | | |
|---|---|---|---|
| 418,337 | 12/1889 | Kors | 81/57.39 |
| 3,745,858 | 3/1973 | Biach | 81/57.39 |
| 4,141,262 | 2/1979 | Smith | 81/57.39 |
| 4,275,620 | 6/1981 | Collins | 81/57.39 |
| 4,336,727 | 6/1982 | Junkers | 81/57.39 |
| 4,448,906 | 5/1984 | Collins | 81/57.39 |
| 4,513,645 | 4/1985 | Grabovac et al. | 81/57.39 |

FOREIGN PATENT DOCUMENTS

| | | | |
|---|---|---|---|
| P3407 | 2/1984 | Fed. Rep. of Germany . | |
| P3420 | 6/1984 | Fed. Rep. of Germany . | |
| 579132 | 11/1977 | U.S.S.R. | 81/57.39 |

*Primary Examiner*—Frederick R. Schmidt
*Assistant Examiner*—Maurina Rachuba
*Attorney, Agent, or Firm*—William David Kiesel; Robert C. Tucker; Timothy J. Monahan

[57] ABSTRACT

A ratcheting hydraulic torque wrench in which the lever arm is provided with a tracking arm guided within a channel in a wrench body. The tool head is divided into a ratcheting portion containing roller drive pins, and a notched portion to allow access to pipe flange nuts.

12 Claims, 2 Drawing Sheets

RATCHETING BOX WRENCH

RELATED APPLICATIONS

This is a continuation of United States patent application Ser. No. 06/786,836 filed by the inventor herein on Oct. 11, 1985, now U.S. Pat. No. 4,669,338, patented June 2, 1987 and entitled "Ratcheting Box Wrench", specific mention herein being made to obtain the benefit of its filing date.

BACKGROUND OF THE INVENTION

1. Field of the Invention

This invention relates in general to hydraulic torque wrenches and more particularly to ratcheting hydraulic torque wrenches.

2. Description of the Prior Art

The petro-chemical industry, as well as industry in general, relies on extensive use of pipes and large valves with bolted or studded flanges. Very large make-up torque of the magnitude of 2,500–5,000 ft-lbs rising to as high as 75,000 ft-lbs are needed to tighten down the nuts on these flanges. Additionally, break-out torque required may be four or five times the corresponding make-up torque needed for a given flange.

Consequently, heavy-duty wrenches, primarily hydraulic torque wrenches, are needed. Wrenches in the prior art use a relatively complex system of gears, bushings, drive pawls, pins, etc., resulting in wrenches which are physically large, heavy and particularly cumbersome. This complexity gives rise to equipment mechanical failure.

Wrenches in the prior art have a poor mechanical advantage with the result that their torquing capacity is small in comparison to their bulk. The more advanced wrenches in the prior art require reaction plates to operate. Some, because of their pinned wrench bodies, often require reaction rollers to increase the mechanical advantage of the wrench. These wrenches usually are not consistently accurate within many required specifications. While high torque is developed by these designs for a given weight of the wrench, a great amount of space is still required around the workpiece for such wrenches to operate. Space restrictions exist between flange nuts and pipe walls or surfaces adjacent to the flange. This problem of turning a bolt or nut in a confined space is no small problem and has been an unsolved need in industry.

Safety is a large factor not only from the obvious awkwardness of handling a large, heavy wrench (approximately 80 lbs) leading to the malalignment of a wrench on a bolt or dropping a wrench in an unbalanced position, but also for the improper tightening of a nut itself. In one example, improper tightening of compressor valves can result in a lethal explosion and fire when natural gas escapes after the nuts on studs are over-tightened and fail from stress fatigue and tension.

Examples of the present state of the art can be seen in the following U.S. Pat. Nos.:

| U.S. PAT. NO. | INVENTOR | ISSUED | TITLE |
|---|---|---|---|
| 3,745,858 | John L. Biach | 7/17/73 | TORQUING DEVICE |
| 4,027,561 | John K. Junkers | 6/07/77 | HYDRAULIC WRENCH |
| 4,385,533 | Bobby W. Collins | 5/31/83 | UNIVERSAL REACTION |

-continued

| U.S. PAT. NO. | INVENTOR | ISSUED | TITLE |
|---|---|---|---|
| 4,448,096 | Bobby W. Collins | 5/15/84 | PLATE FLUTTER LIFT FOR TORQUE WRENCH |

SUMMARY OF THE INVENTION

Therefore, one object of this invention is to provide a wrench with an increased mechanical advantage by effectively lengthening the lever arm by moving the pivot point to coincide with the center of the nut to be turned.

Another object is to assure accurate torquing.

Another object of this invention is to reduce the number of parts needed to construct a torque wrench and at the same time reduce the weight.

Still another object of this invention is to provide a wrench in which a variety of tool heads may be used.

Still a further object of this invention is to provide a hydraulic torque wrench capable of operating in confined spaces to the extent of fitting all fifty-seven API flange sizes.

Accordingly, a hydraulic torque wrench in which the base of the hydraulic cylinder attaches directly to the end of the wrench body, and the piston rod of the hydraulic cylinder attaches to the lever arm of the tool head whereby the lever arm is provided with a tracking arm guided within a channel in the wrench body. The tool head is divided into a ratcheting portion containing roller drive pins, and a notched portion to allow access to pipe flange nuts.

PREFERRED EMBODIMENTS OF THE INVENTION

Figure 1:
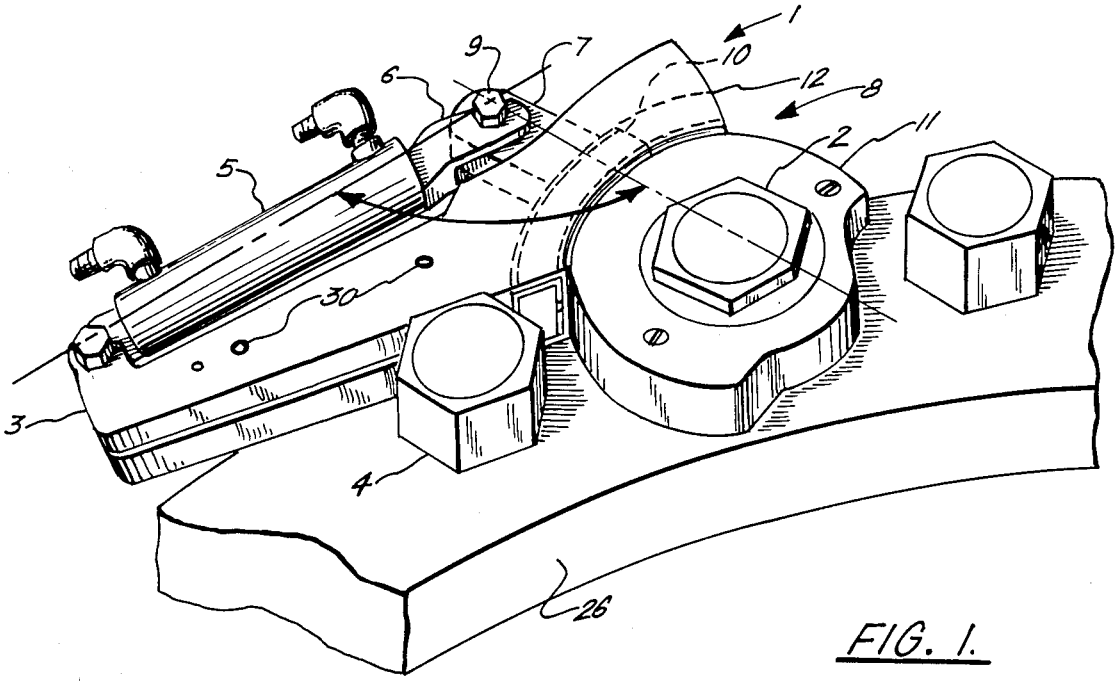
FIG. 1 is a perspective view of the ratcheting box wrench.

Referring now to FIG. 1 wherein the ratcheting box wrench referred to generally as 1 is positioned on a flange-nut 2 in a manner so that the wrench body 3 will contact an adjacent flange-nut 4. This will provide a base from which the ratcheting box wrench 1 will gain leverage. The hydraulic cylinder 5 is activated and its piston rod (not shown) will extend causing the front cylinder clevis 6 to make contact with the lever arm 7 of the tool head assembly 8. The front cylinder clevis 6 is connected to the lever arm 7 with a connection pin 9. As the lever arm 7 is turned by the hydraulic cylinder 5, the tool head assembly 8 rotates. This rotation is further guided by a tracking arm 10 which is an integral part of the tool head assembly 8 located between the retainer arm 11 and the lever arm 7. The tracking arm 10 moves within an arcuate channel 12 (shown by hidden lines on FIG. 1) within the wrench body 3. If this tracking arm is properly dimensioned, it will increase the wrench's ability to operate within a confined space since there will be no need to remove and reattach the wrench to the nut during the exercise of a normal ratchet cycle.

Figure 2:
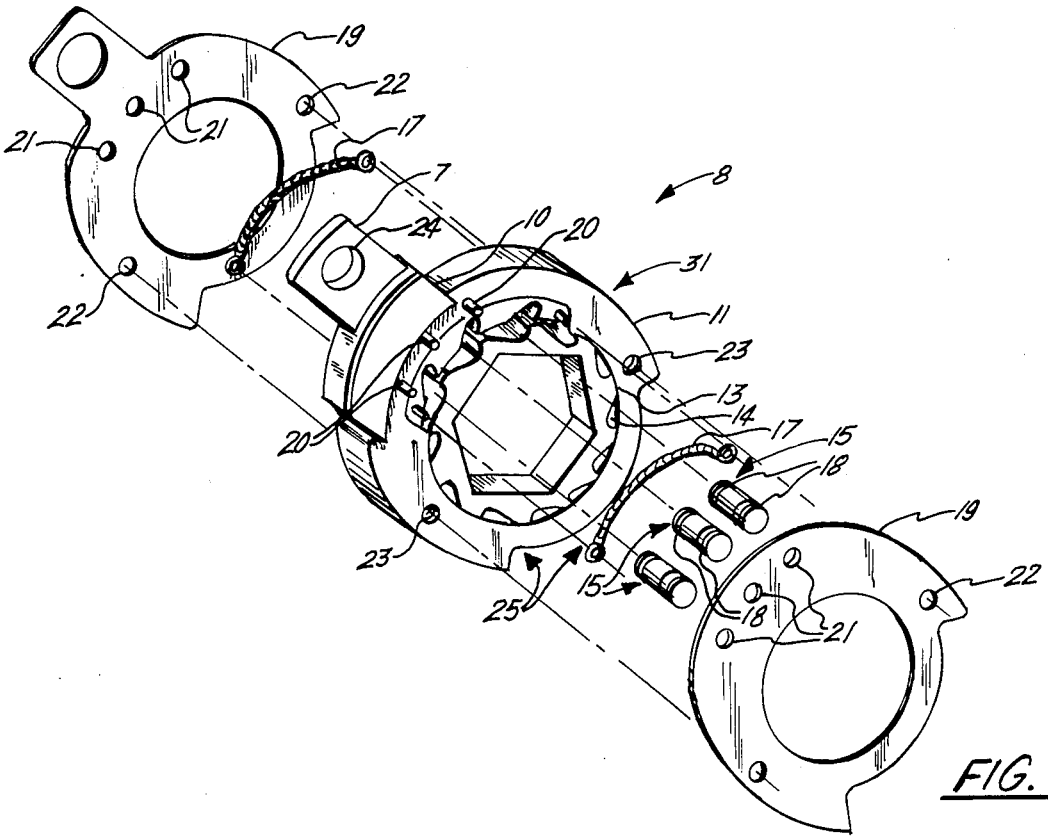
FIG. 2 is an exploded view of the tool head assembly.
Figure 3:
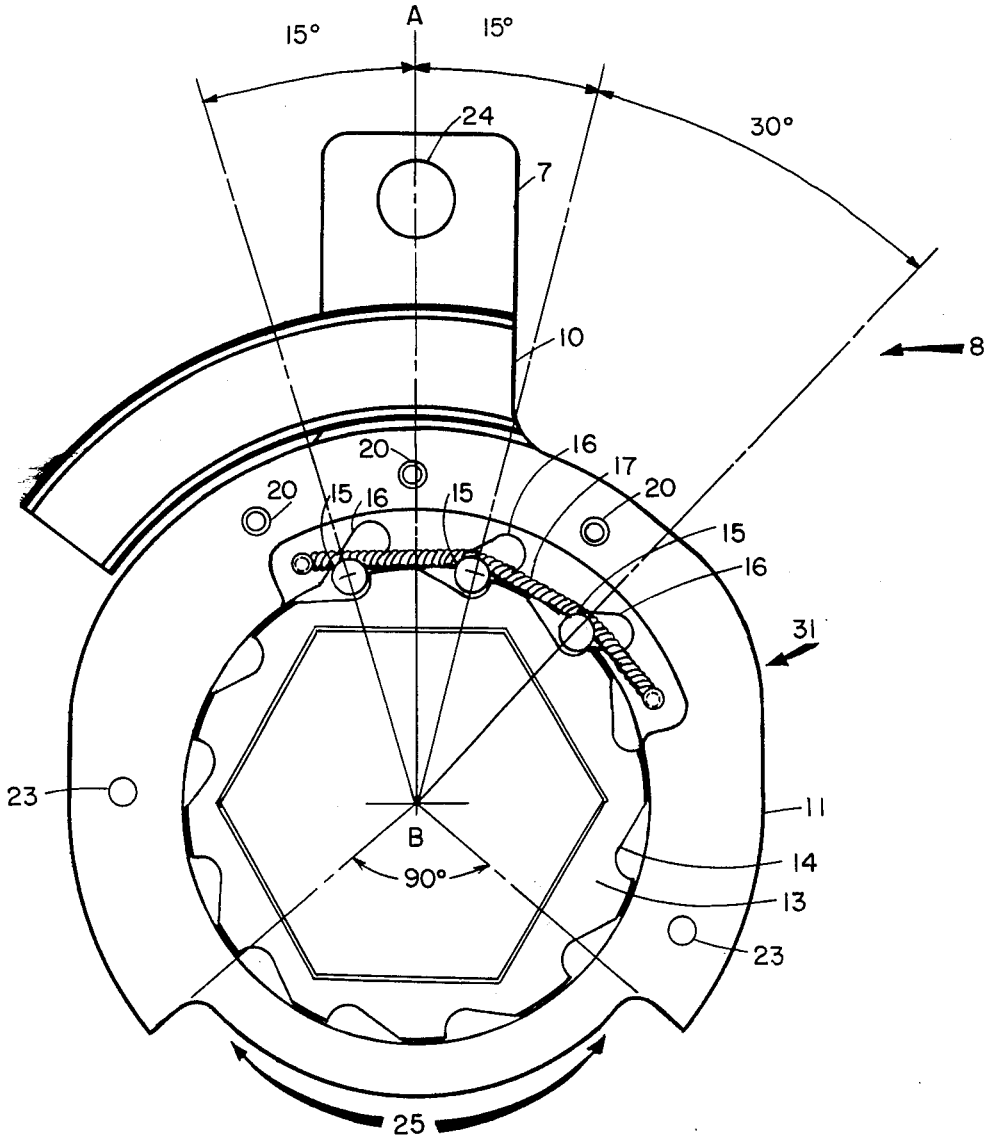
FIG. 3 is a plan view of the tool head assembly shown without its cover shield.

FIG. 2 shows an exploded view of the tool head assembly 8 which operates in the same plane as the hydraulic cylinder 5 with increased mechanical advantage over hydraulic socket wrenches. This feature can be exemplified by comparing a hand box wrench to a hand socket wrench. A box wrench produces a torquing action in the same plane as that of the turning nut. Contrast the power loss due to deflective reaction loads occurring when the socket wrench's lever arm torques in a plane a distance above or below the nut. A socket wrench has a force acting only parallel to the plane of the nut. The resultant vector of the socket wrench is not as efficient as an equal singular force acting the same plane as the turning nut.

The tool head assembly 8 also provides the ratcheting aspect of this invention. The tool head assembly 8 consists of a tool head 31 to which the tracking arm 10 and the lever arm 7 are an integral part. Within the tool head 31 is a retainer rim 11 as well as a ratchet gear 13 which contacts the workpiece, in this instance, flange-nut 2. The ratchet gear 13 has a series of teeth 14 which are bevelled at one side and equally spaced around the circumference of the ratchet gear 13. These teeth 14 provide a recess in which the roller drive pins 15 are positioned in and out of to provide the ratcheting motion. When the roller drive pins 15 are in the recesses, they are in a drive position to allow for the tool head assembly 8 to rotate the flange-nut 2. When the tool head assembly 8 is ratcheted back to its original position in a manner to allow it to make a second turn of the flange-nut 2, the roller drive pins 15 slip into a ratcheting slot 16 of the retainer rim 11. The roller drive pins 15 are positioned and held in place for the drive portion of the cycle by springs 17 located on both sides of the roller drive pins 15. The roller drive pins 15 have circumferential spring alignment grooves 18 which keep these springs 17 properly positioned. The tool head assembly 8 is equipped with shields 19 which are positioned on both sides of the tool head 31 to protect the inner working mechanisms. The shields 19 are secured by screws (not shown) through screw holes 22 and 23 located on shields 19 and retainer rim 11.

The lever arm 7 is provided with a connection pin aperture 24 through which the connection pin 9 is placed attaching the front cyclinder clevis 6.

Retainer rim 11 is provided with a ratcheting portion containing ratcheting slots 16, and a notched portion 25 without ratcheting slots. Notched portion 25 is positioned opposite lever arm 7 and describes an angle of approximately 90°. Retainer rim 11 is cut out to provide a minimum thickness between flange nut 2 and the periphery of notched portion 25. Or, in other words, restricting the ratcheting portion to one side of retainer rim 11 allows the opposite side of retainer rim 11 to be cut out to fit between flange nut 2 and a perpendicular obstruction, such as a pipe, on the concave side of flange 26. This clearance has been found to be about 3/10 of an inch in field conditions.

In a preferred embodiment, only three roller drive pins 15 are used, and these roller drive pins 15 are located an equal distance 30 degrees apart on the circumference of the ratchet gear 13. Two of these roller drive pins 15 are each located on opposite sides and 15 degrees from an imaginary centerline drawn from the centers of the connection pin aperture 24 and the ratchet gear 13. The third roller drive pin 15 is located another 45 degrees around the circumference from the same centerline on the compression side of retainer rim 11. The compression side of retainer rim 11 is opposite the wrench body 3 side of the centerline.

Additionally, a preferred embodiment of the wrench body 3 will be such that the wrench body consists of two halves which are joined together by allen inserts 30.

The ratchet gear 13 can be of design on the inside to allow for any number of sizes of flange-nuts, studs or bolts as well as having a square drive adapter.

Many other variations, modifications, and alternate embodiments may be made in the apparatus and techniques hereinbefore described, by those having experience in this technology, without departing from the concept of the present invention. Accordingly, it would be clearly understood that the apparatus and methods depicted in the accompanying drawings and referred to in the foregoing description are illustrative only and are not intended as limitations on the scope of this invention, as defined in the following claims.

What I claim is:

1. A torque wrench for flange nuts, comprising:

(a) a wrench body having an arcuate channel at one end;

(b) a lever arm intersecting said channel;

(c) a means, connected to said lever arm and matingly slidable within said channel, for guiding said lever arm;

(d) a retainer rim, having an edge connected to an end of said lever arm, said retainer rim further having a ratcheting portion, proximate to said lever arm, and confined within an angle of 270° on said retainer rim;

(e) a ratcheting gear, rotatably positioned within said retainer rim, having:

(i) a means for gripping said flange nut;

(ii) a plurality of circumferentially positioned teeth;

(f) a ratcheting means, within said ratcheting portion of said retainer rim, for engaging said teeth of said ratcheting gear when torque is applied in one direction and for allowing relative rotation between said retainer rim and said ratcheting gear when torque is applied in an opposite direction; and (g) a reciprocating power means for pivoting said lever arm, having a first end pivotally connected to an opposite end of said lever arm, and a second end pivotally connected to an opposite end of said wrench body.

2. A torque wrench according to claim 1, wherein said guide means comprises an arcuate tracking arm transverse to said lever arm.

3. A torque wrench according to claim 1, wherein said retainer rim further comprises a notched portion, opposite said lever arm, which is cut out to provide a minimum thickness between said flange nut and periphery of said notched portion.

4. A torque wrench according to claim 3, wherein said notched portion comprises an angle of approximately 90° on said retainer rim.

5. A torque wrench according to claim 4, wherein said ratcheting portion is confined within an angle of 60° on said retainer rim.

6. A torque wrench according to claim 1, wherein said flange nut gripping means is a hexagonal aperture.

7. A torque wrench for flange nuts, comprising:

(a) a wrench body having an arcuate channel at one end;

(b) a lever arm intersecting said channel;

(c) a means, connected to said lever arm and matingly slidable within said channel, for guiding said lever arm;

(d) a retainer rim, having an edge connected to an end of said lever arm, said retainer rim further having:
(i) a ratcheting portion, proximate to said lever arm, having a plurality of axially aligned ratcheting slots;
(ii) a notched portion, opposite said lever arm, wherein said retainer rim is cut out to provide a minimuim thickness between said flange nut and a periphery of said notched portion;
(e) a plurality of roller drive pins positioned to be retractable within said ratcheting slots;
(f) a means for urging said roller drive pins out of said ratcheting slots;
(g) a ratcheting gear, rotatably positioned within said retainer rim, having:
(i) a means for gripping said flange nut;
(ii) a plurality of circumferentially positioned teeth, said teeth aligned to force said roller drive pins into said ratcheting slots when torque is applied in one direction, and to lock said roller drive pins between said retainer rim and said ratcheting gear when torque is applied in an opposite direction; and
(h) a reciprocating power means for pivoting said lever arm, having a first end pivotally connected to an opposite end of said lever arm, and a second end pivotally connected to an opposite end of said wrench body.

8. A torque wrench according to claim 7, wherein said guide means comprises an arcuate tracking arm transverse to said lever arm.

9. A torque wrench according to claim 7, having said ratcheting slots confined within an angle of 60° on said retainer rim.

10. A torque wrench according to claim 7, wherein said notched portion comprises an angle of approximately 90° on said retainer rim.

11. A torque wrench according to claim 9, wherein said plurality of ratcheting slots is at least two but fewer than 4.

12. A torque wrench according to claim 9, wherein said ratcheting slots are spaced at least 15° but less than 45° apart on said retainer rim.

* * * * *